US007895802B2

(12) United States Patent
Kurz

(10) Patent No.: US 7,895,802 B2
(45) Date of Patent: Mar. 1, 2011

(54) PROFILED RAIL SYSTEM FOR COVERING JOINTS

(75) Inventor: Sebastian Kurz, Eyrs (IT)

(73) Assignee: Karl Pedross AG, Latsch (IT)

( * ) Notice: Subject to any disclaimer, the term of this patent is extended or adjusted under 35 U.S.C. 154(b) by 391 days.

(21) Appl. No.: 11/596,510

(22) PCT Filed: Oct. 14, 2005

(86) PCT No.: PCT/EP2005/011056

§ 371 (c)(1),
(2), (4) Date: Nov. 14, 2006

(87) PCT Pub. No.: WO2006/056275

PCT Pub. Date: Jun. 1, 2006

(65) Prior Publication Data

US 2007/0199275 A1 Aug. 30, 2007

(30) Foreign Application Priority Data

Nov. 22, 2004 (DE) ..... 20 2004 018 094 U

(51) Int. Cl.
*E04D 1/36* (2006.01)

(52) U.S. Cl. ..... 52/468; 52/464; 52/395; 52/396.04

(58) Field of Classification Search ..... 52/468, 52/716.6, 716.7, 718.04, 716.05, 716.06, 52/717.03, 717.04, 717.05, 287.1, 395
See application file for complete search history.

(56) References Cited

U.S. PATENT DOCUMENTS 2,996,751 A 8/1961 Roby et al.
3,254,361 A * 6/1966 Craven et al. ..... 16/16
3,473,278 A * 10/1969 Gossen ..... 52/288.1
3,696,461 A * 10/1972 Kelly ..... 16/16
4,067,155 A * 1/1978 Ruff et al. ..... 52/105
4,156,300 A * 5/1979 Jarjavail et al. ..... 16/5
4,189,880 A * 2/1980 Ballin ..... 52/202
4,385,850 A * 5/1983 Bobath ..... 403/205
5,155,952 A * 10/1992 Herwegh et al. ..... 52/100
5,657,598 A 8/1997 Wilbs et al.

(Continued)

FOREIGN PATENT DOCUMENTS

DE 296 19 983 U1 1/1997

(Continued)

OTHER PUBLICATIONS

International Search Report.

*Primary Examiner*—Brian E Glessner
*Assistant Examiner*—James Ference
(74) *Attorney, Agent, or Firm*—Collard & Roe, P.C.

(57) ABSTRACT

The invention relates to a profiled rail system for covering joints between bottom and/or wall linings, consisting of a base rail and a covering rail which are connected by means of an intermediately placed retaining part, wherein the base rail is provided with an upright web with a retaining head formed on one end and which is held by the intermediately placed retaining part such that it is rotationally moveable and the retaining part is embodied essentially as a U-shaped rail which is open in a downward direction and provided with retaining elements, wherein the outer walls of the U-shaped rail are held by webs formed in a downward direction on the covering rail.

10 Claims, 3 Drawing Sheets

U.S. PATENT DOCUMENTS

| | | | | |
|---|---|---|---|---|
| 5,939,670 | A * | 8/1999 | Shteynberg et al. | 174/481 |
| 6,340,264 | B1 * | 1/2002 | Nelson | 403/297 |
| 6,345,480 | B1 * | 2/2002 | Kemper et al. | 52/395 |
| 6,357,192 | B1 * | 3/2002 | Schluter | 52/459 |
| 6,550,205 | B2 * | 4/2003 | Neuhofer, Jr. | 52/464 |
| 6,588,165 | B1 * | 7/2003 | Wright | 52/506.05 |
| 6,647,680 | B2 * | 11/2003 | Daly et al. | 52/287.1 |
| 6,729,092 | B2 * | 5/2004 | Grosjean | 52/395 |
| 7,392,627 | B2 * | 7/2008 | Sondermann | 52/464 |
| 2002/0000072 | A1 * | 1/2002 | McGrath et al. | 52/466 |
| 2003/0051426 | A1 * | 3/2003 | Kornfalt | 52/396.1 |

FOREIGN PATENT DOCUMENTS

| | | | |
|---|---|---|---|
| DE | 200 15 244 | U1 | 2/2001 |
| DE | 20 2004 000706 | | 5/2004 |
| EP | 0 711 886 | A | 5/1996 |
| EP | 1 403 444 | A | 3/2004 |

* cited by examiner

PROFILED RAIL SYSTEM FOR COVERING JOINTS

CROSS REFERENCE TO RELATED APPLICATIONS

Applicant claims priority under 35 U.S.C. §119 of German Application No. 20 2004 018 094.4 filed Nov. 22, 2004. Applicant also claims priority under 35 U.S.C. §365 of PCT/EP2005/011056 filed Oct. 14, 2005. The international application under PCT article 21(2) was not published in English.

The innovation relates to a profiled rail system for covering joints between floor and/or wall coverings, in order to obtain smooth transitions even when adjacent floor coverings have different heights. Joint bridges of this type are known from the prior art. Although such arrangements are already capable of being adapted to predetermined height tolerances, it is nevertheless desirable to extend the adaptability even further, so that even large joint depths or pronounced depth variations can be dealt with by means of a single product design. Such a requirement is demanded, in particular, by the trade, so that there is no need to keep in stock too many different types. Another requirement in this context is that the connection should have a good hold and be adaptable to all situations. For example, EP 1 403 444 discloses a profiled rail system, in which a profiled shank with a holding head, onto which the covering rail is placed, is plugged in the base rail. The plug connection of a shank in a longitudinal groove has lateral instability, particularly when the connection is held pivotably with respect to the covering rail put in place.

The object of the innovation is, therefore, to provide a profiled rail system for covering joints, in which a firm, secured connection between the base rail and covering rail is made, which can be used both for small and for very large joint heights.

The object is achieved, according to the innovation, by means of the features of claim 1. Due to the upstanding fixed holding head on the web of the base rail, the interposed holding part has a good hold in spite of the rotational moveable retention. The selected rotational moveability can readily have a generous angular deflection if the clamping and holding effect is sufficiently taut. The design of the interposed holding part in the form of a U-rail is particularly advantageous, because the holding elements can be accommodated protectively and in a space-saving way inside the U-rail, the entire width of the U-rail can be utilized for the pivoting region and the covering rail put in place can be retained with its two webs on the outer walls of the U-rail with a sufficient clamping effect. Here, too, the height position can be adapted and readjusted in a known way. Thus, a U-rail is compact and stable and easily withstands any tensile and compressive forces.

So that the holding part can be supported rotationally moveably on the base rail, the holding head of the web of the base rail has a cross section of circular design. This rounded end extends over the entire length of the web. Such a shape can be produced preeminently and cost-effectively by the extrusion method. Through the slender web and the large rounded closing-off head, the holding part put in place can be pivoted on both sides over at least 100. It is also intended to provide the surface of the circular head with a structure or with a longitudinally running flute, in order to give the retention part a better hold and to find the central orientation for the covering rail. It need not be mentioned that the holding part should have a corresponding elevation.

In order to secure the holding part on the holding head favorably to the base rail, there are several possibilities. The features of claim 1 have proved highly advantageous. The spring element is a part which is produced from an elastic and resilient material and which projects from the upper transverse wall into the inner space of the U-rail and is supported with its outwardly bent-up ends on the sidewalls of the U-rail.

The special shaping and mounting give the spring head a good and firm hold on the holding head of the web, the tension of which remains stable due to the lateral support of the bent-up ends. The strip material claimed refers merely to the fact that the spring element is thin-walled. It could, for example, be manufactured in one piece with the U-rail if both are produced from the same material.

A holding part with a spring element would also be highly advantageous if it were equipped with the features of claim 2. The spring element is admittedly preferably produced from sheet steel. A plastic part would, however, also be conceivable, because there are also types of plastic which have good spring properties. In this version according to claim 2, the spring element is a loose part which is pressed into the inner space of the U-rail and clamped. The free, outwardly directed ends engage into the structure of the inner sidewalls with such firmness that there is no fear of any independent release. The desired bracing is brought about by the pressure of the spring heads against the upper transverse wall. The manufacture of the rail system becomes more versatile due to the individual production of the springs. Above all, the spring elements can also be used individually at intervals, depending on the length of the U-rail or of the covering rail.

It has also proved to be highly advantageous to equip the holding part to be interposed with the features of claim 3. This manufacture may take place both in plastic and in metal. In the case of plastic, corresponding molds would have to be produced. Where metal is concerned, the walls of the U-rail would be partially indented and bent into their spring shape. It would also be possible, however, to manufacture the spring element separately and to hold it at intervals by means of thin webs, whereupon the U-rail is then cast and the web are at the same time encased, so that the spring element are interposed between the U-rail portions. In this version, too, the spring head covering more than 180° affords a sufficient hold for a rotationally moveable connection on the holding head of the base rail. The free ends of the spring are secured to the lower edge of the U-rail, so that the spring possesses sufficient tension. The shorter the portions of the spring elements and of the U-rail portions are, the more this profiled rail system can be produced in a more versatile and more cost-saving way.

A further and advantageous securing of the interposed holding part is possible if the features of claim 4 are utilized. The integrally formed webs preferably consist of plastic in the same way as the U-rail itself. For the snapping onto the holding head of the base rail, three webs distributed in the rounding are the most beneficial. Their elasticity makes it possible that they can receive the holding head securely between them as a rotary bearing and that the U-rail can be angled in the required region. High angular freedom is achieved when two webs are arranged on one side at a short interval and the third web is arranged opposite the two. However, even more webs for support are possible. This U-rail with the integrally formed webs can be produced highly cost-effectively by the extrusion method.

There is no difficulty in allowing the webs to extend over the length of the U-rail, particularly when the rail is produced by the extrusion method. This ensures that the holding part, over its entire length, retains the base rail.

It is highly advantageous, furthermore, if the features of claim 6 are utilized. It goes without saying that the covering rail must extend over the entire length of the joint. By contrast, it is entirely sufficient if this covering rail is secured at intervals only to the base rail. This saves a large amount of material and is cost-effective, as demanded by the trade.

When the holding pieces are used at intervals, it is necessary, as an alternative, that the features of claim 7 are adopted. In this version, there is high variability, since the U-rail, which serves as a holding part for the covering rail, may consist both of plastic and of metal. The same applies to the spring segment which is required for securing to the base rail. And because the two individual parts are first assembled to form a unit, only the shaping is important in the case of the individual parts so as to ensure that they are effectively connected to one another. The material is in this case unimportant. It is necessary merely to have the required properties of strength and elasticity. Since the parts are beneficially produced as mass production parts, the entire profiled rail system is highly cost-effective.

As regards the use of portions, another variant is also possible, for which the features of claim 8 are utilized. If the portion consists of metal, the U-rail is indented vertically in the sidewalls and a part region of the wall is shaped into a spring. The portions can even more beneficially be produced from plastic in a mold. Both the spring element and the rail segment immediately having the desired shape by which they can fulfill their tasks. These parts, too, are mass production parts which can be produced beneficially by permanent mold casting.

It has provided favorable, in practice, if the features of claim 9 are utilized. Plastic parts are not subject to corrosion, and because both the base rail and the interposed holding part are always covered completely, the visual appearance of these parts is entirely unimportant. Plastic possesses the required mechanical properties of strength, elasticity, breaking strength and resistance, and therefore its use affords nothing but advantages. Moreover, it can be processed beneficially by the injection molding or extrusion method.

Finally, it is particularly advantageous for the profiled rail system if the features of claim 10 are used. Owing to the profiling, which may be graining, fluting or a row of sawteeth, the overengaging webs have a good hold, above all when they themselves are also provided with a corresponding structure. Owing to a very slight angling of the webs, the have a prestress when they engage over the outer walls of the U-rail, and the clamping grip is a secure hold.

Exemplary embodiments of the innovation are described in more detail below with reference to the drawings in which.

Figure 1:
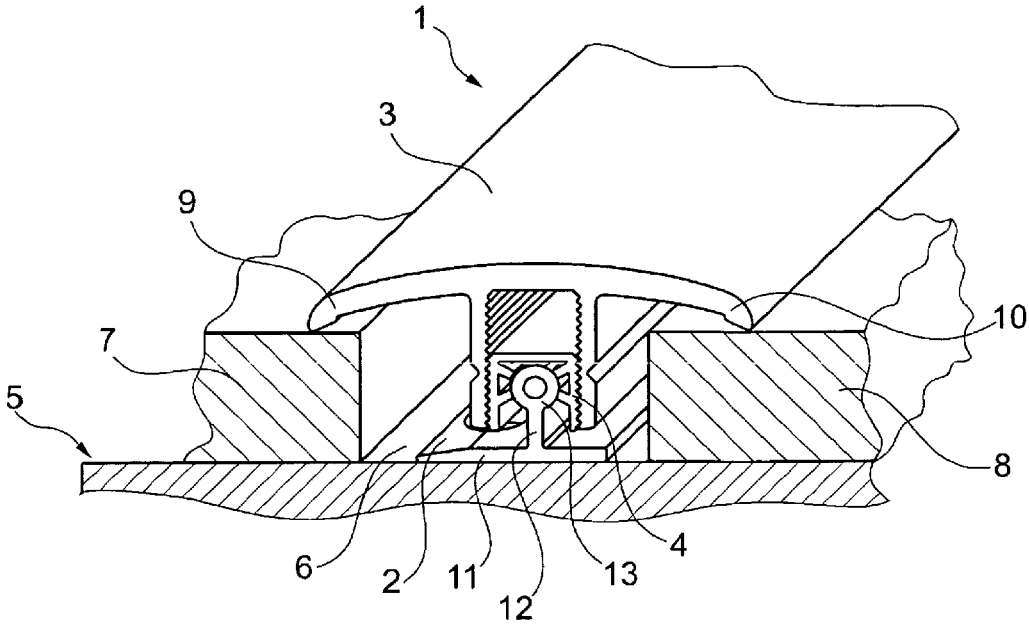
FIG. 1 shows a profiled rail system in the assembled state in which floor coverings of equal thickness are held.

The profiled rail system 1 illustrated in FIG. 1 consists of a base rail 2 and of a covering rail 3 which are connected to an interposed holding part 4. The base rail 2 is secured by adhesive bonding or by means of screws, not illustrated, to the floor 5 in a groove or joint 6 which occurs between floor coverings 7, 8 adjacent to one another at an interval. The covering rail 3 secured to the base rail 2 by means of the holding part 4 bridges with its covering wings 9, 10 the groove 6 and is supported on the ends of the floor coverings 7, 8 so that these are held down. If the floor coverings 7, 8 are of equal thickness, as illustrated in FIG. 1, the covering rail 3 sits completely straight on the interposed holding part 4. Often, however, two floor coverings 7, 8 of different thickness butt against one another. In order, even in this case, to have a smooth transition in which the covering wings 9, 10 butt onto the floor coverings 7, 8 on both sides, the covering rail 3 has to be angled. As may be gathered from FIG. 2, the covering rail 3 together with the interposed holding part 4 can be brought jointly into an oblique position by being rotated on the holding head 13.

Figure 3:
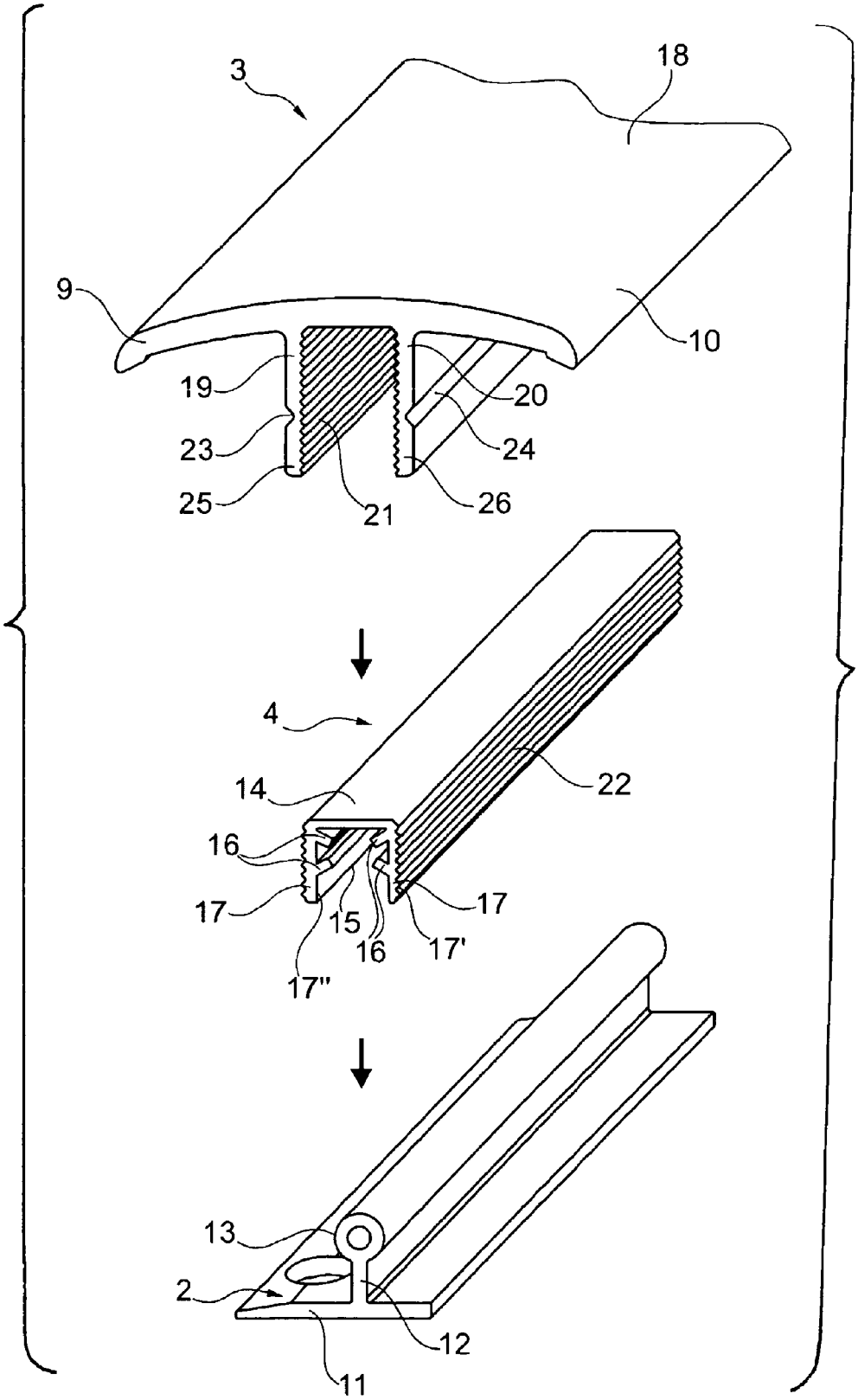
FIG. 3 shows the profiled rail system according to FIG. 1 in an exploded illustration so that the individual parts can be seen more clearly.

So that the individual parts can be seen more clearly in terms of their configuration and functioning, the rail system 1 is illustrated in FIG. 3 as an exploded drawing. The lowest part shown is the base rail 2 with a baseplate 11 in which a bore for possible securing by means of screws in indicated. A web 12 extends upright from the baseplate 11. This web 12 has at its free end a reinforcement of circular cross section which is designed as a holding head 13 for a holding part 4. This holding head 13 is preferably made hollow in order to save material. It extends over the entire length of the base rail 2.

Located above the base rail 2 is the holding part 4 which is designed as a downwardly open U-rail 14. In the inner space 15 of the U-rail 14, holding elements in the form of webs 16 are provided, which are integrally formed on the inner sidewalls 17 of the U-rail 14. In the present case, two webs 16, which are directed toward the center of the inner space 15, are provided at an interval on each sidewall 17. These webs 16 extend into the inner space 15 to an extent such that they firmly grip between them with their free ends the holding head 13 of the base rail 2, although said holding head remains rotationally moveable. Since the webs 16 are directed into the center only from the sidewalls, the necessary space remains from below in order to press the holding head 13 between the free ends of the webs 16 which have the required elasticity for this purpose. Preferably, the U-rail 14 together with the integrally formed webs 16 is manufactured from plastic having a Shore hardness of 74° to 76°. With this material strength, the holding head 13 is surrounded from outside to an extent such that it cannot automatically jump out of the mounting. The webs 16 extend over the entire length of the U-rail 14. They consequently have a firm, but rotationally moveable grip on the holding head 13.

FIG. 3 illustrates as the uppermost attachment part the covering rail 3. The latter consists of the cover plate 18 with the lateral covering wings 9, 10 which may be designed with a different width. It is also to known to draw the cover plate 18 on one side when it is used as a lateral closure. Two integrally formed webs 19, 20 extend from the underside of the cover plate 18 which are arranged at an interval with respect to one another which corresponds to the width of the U-rail 14. These webs 19, are provided on their inside, in the longitudinal direction, with a fluting 21 of sawtooth form which cooperates with a fluting 22 on the outer sidewall 17 of the U-rail 14 with a holding effect when the covering rail 3 is pressed onto the holding part 4. Any other surface structure, such as, for example, a graining, could also be conceivable. The surfaces lying on one another have to have a good hold against possible slipping out of place. As can be seen on the outsides of the webs 19, 20, in each case a longitudinal notch 23, 24, is provided as a predetermined breaking point. The lower ends 25, 26 of the webs 19, 20 are broken off at this notch 23, 24 if the floor covering 7, 8 has only a small thickness and the webs 19, 20 run the risk of sitting on the baseplate 11 of the base rail 3 before the covering wings 9, 10 press onto the floor covering 7, 8. The covering rail 3 is preferably produced from a wood/plastic mixture. The material could also be wood, metal or even plastic.

Figure 2:
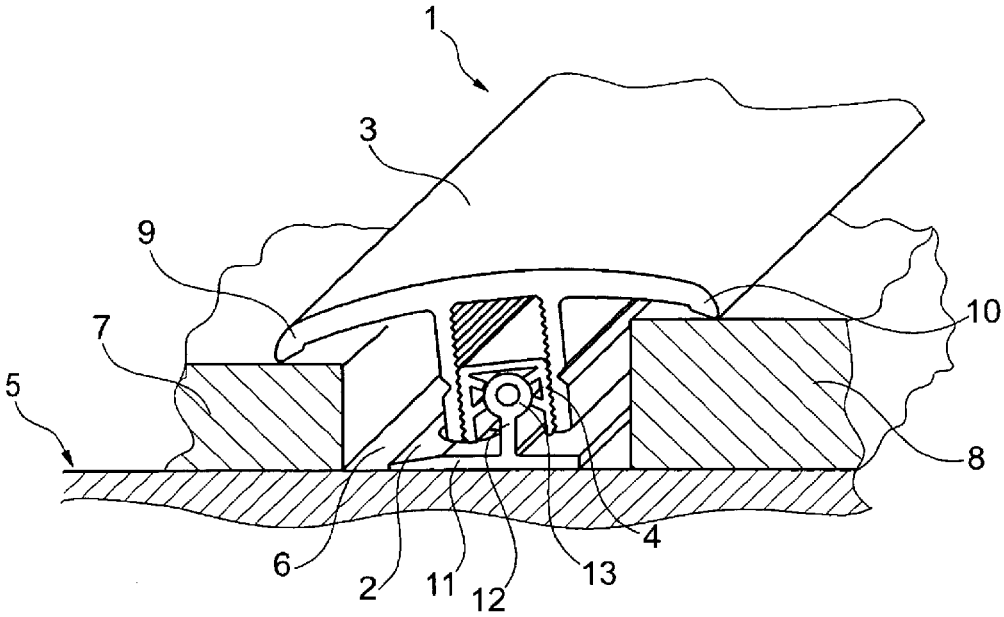
FIG. 2 shows the same profiled rail system in an installation with floor coverings of different thickness and with an angularly adapted covering rail.
Figure 4:
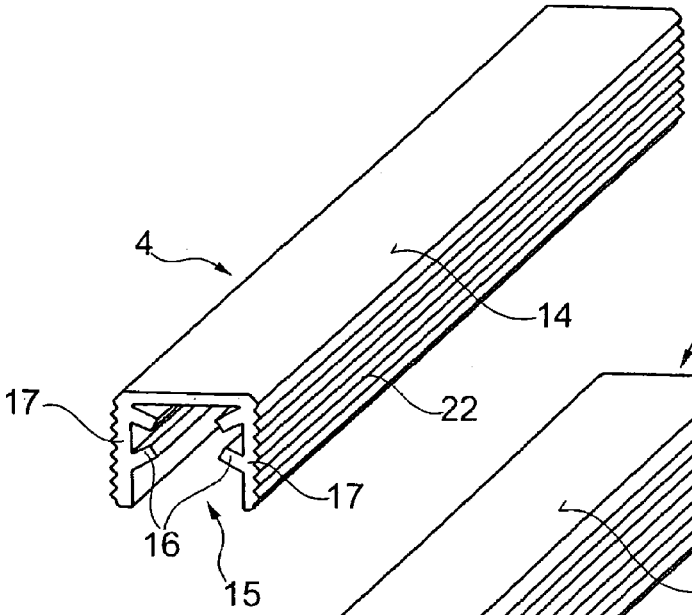
FIG. 4 shows an interposed holding part which is used in FIG. 2.

The holding part 4 used for securing the covering rail 3 to the base rail 2 may even be equipped only with three webs 16 in the inner space 15 of the U-rail, as may be gathered from FIG. 2 and 4. Even three webs 16 offer the required firm grip on the holding head 13 of the base rail 2. It is important in this case that the 3-point mounting on the holding head 13 is maintained. It is sufficient if two webs 16 run toward the center of the inner space 15 at an interval from one inner sidewall 17 and the third web 16 is directed from the other inner sidewall 17 toward the center between the two webs 16, and the holding head 13 fits between the free ends of the webs 16 of the base rail 2. The three-point mounting of the U-rail 14 on the holding head 13 ensures both the desired pivotability and the firm holding grip, as may be gathered from FIG. 2, where the covering rail 3 is angled on account of the floor coverings 7, 8 of different thickness, in order to lie on the floor covering 7, 8 in each case with the covering wings 9, 10. During the mounting of the covering rail 3, specifically when its downwardly directed webs 19, 20 are push over the U-rail 14, the U-rail 14 rotates into the required oblique position as soon as a covering wing 9, 10 sits on the floor covering 7, 8.

Figure 5:
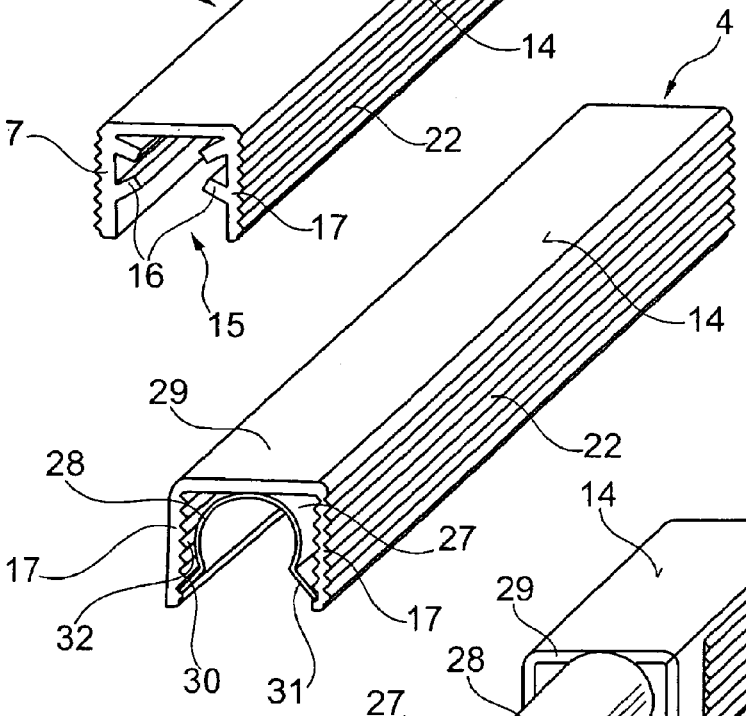
FIG. 5 shows a further holding part in another version.

In the case of a further holding part, which is designed as a U-rail 14, another holder holding element is provided, as shown in FIG. 5. A spring element 27 is inserted into the inner space 15 of the U-rail 14. This spring element 27 has a head 28 which is shaped as an arc of a circle of somewhat more than 180° and with which said spring element presses on the inside against the upper transverse wall 29 of the U-rail 14. The two ends 30, 31 of the spring element 27 are bent obliquely outward after the head arc 28 and engage into a fluting 32 of the inside of the sidewall 17 of the U-rail 14. The spring element 27 is shaped as an independent individual piece and is pressed into the inner space 15 of the U-rail 14 and anchored in the fluting 32, the pressure by means of the head 28 against the upper transverse wall 29 contributing to the required bracing and consequently ensuring reliable securing. The spring elements 27 are preferably short pieces of sheet steel or plastic with a Shore hardness of 74° to 76°, which are inserted at intervals in the U-rail. In a few instances, a continuous spring element 27 is also inserted. Its head arc 28 corresponds to the holding head 13 of the base rail 2, onto which the head 28 is placed in the assembled state, and provides the rotationally moveable connection between the covering rail 3 and base rail 2. The inner surface of the head 28 may be provided with a fine structure and/or a slight narrow elevation in the longitudinal direction, which engages into a corresponding structure and/or into a thin longitudinal flute on the holding head 13.

Figure 6:
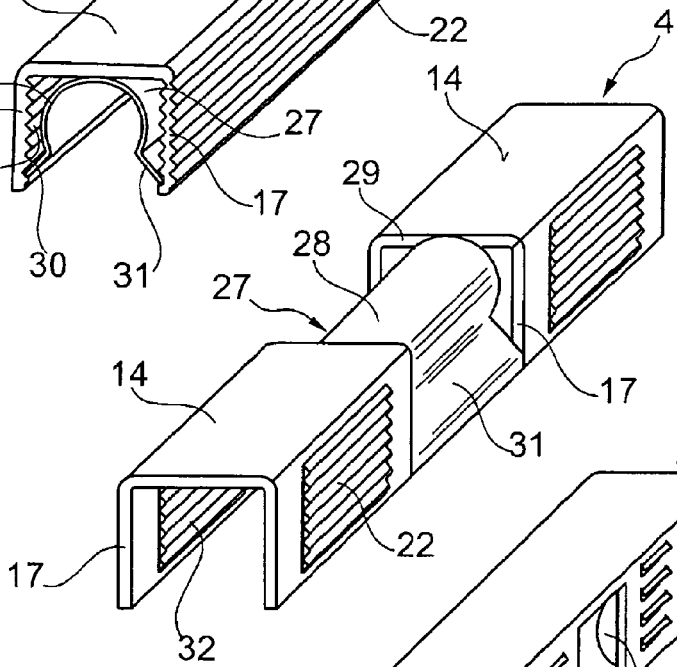
FIG. 6 shows a further-modified holding part.

FIG. 6 shows another holding part 4 in which a spring element 27 is inserted between two U-rail pieces. This part may be produced from metal. In this case, the sidewall 17 and part of the upper transverse wall 29 are indented, and the cut-free portion is bent to form the spring element 27 with the head arc 28 and with outwardly set ends 30, 31. The ends 30, 31 are then anchored laterally to the U-rail 14. On the other hand, these parts are also injection-molded from plastic. The ends 30, 31 of the spring element 27 form a unit with the lower edge of the sidewalls 17. The head 28 of the spring element 27 serves in each case as a rotationally moveable connection between the holding part 4 and the base rail 2, the connection between the holding part and the covering rail 3 being achieved by means of the webs 19, 20 of the latter which engage over the U-rail 14 and grip its sidewalls 17.

Figure 7:
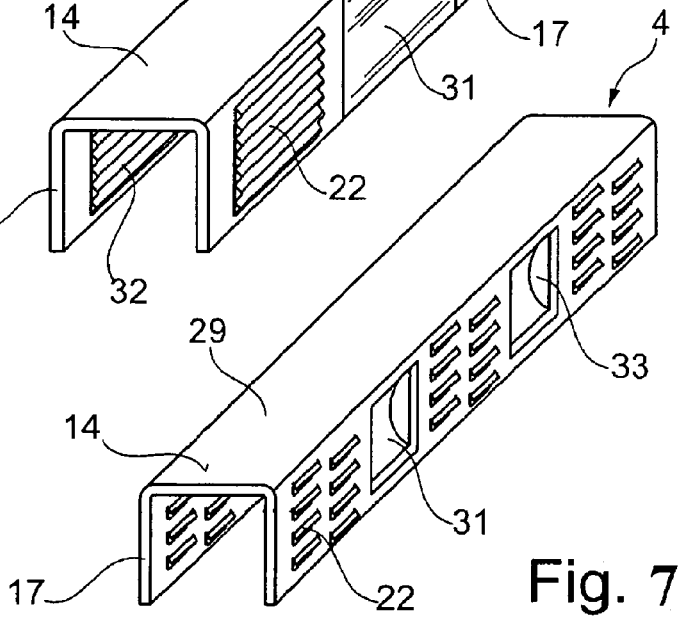
FIG. 7 shows a further version of a holding part.

Finally, FIG. 7 also shows a U-rail 14 as a holding part 4, in which, in the inner space 15, a spring element 27 is integrally formed, the side ends 30, 31 of which can be seen through the cut-out windows 33 in the sidewalls 17. Both the insides and the outsides of the sidewalls 17 are provided with a fluting 22 preferably in the form of a sawtooth profile. This holding part 4 may be manufactured both from metal and from plastic. It is preferably placed as a short part at intervals on the holding head 13 of the base rail in order to serve as a connection part for the covering rail 3 which is to held pivotably.

| List of reference symbols | |
|---|---|
| 1 | profiled rail system |
| 2 | base rail |
| 3 | covering rail |
| 4 | holding part |
| 5 | floor |
| 6 | groove |
| 7 | floor covering |
| 8 | floor covering |
| 9 | covering wing |
| 10 | covering wing |
| 11 | baseplate |
| 12 | web of the base rail |
| 13 | holding head |
| 14 | U-rail |
| 15 | inner space |
| 16 | webs of the U-rail |
| 17 | sidewall |
| 18 | coverplate |
| 19 | web of the covering rail |
| 20 | web of the covering rail |
| 21 | fluting of the webs |
| 22 | fluting of the holding part |
| 23 | longitudinal notch |
| 24 | longitudinal notch |
| 25 | lower end |
| 26 | lower end |
| 27 | spring element |
| 28 | head |
| 29 | transverse wall |
| 30 | end of the spring element |
| 31 | end of the spring element |
| 32 | fluting of the inner wall |
| 33 | window |

The invention claimed is:

1. A profiled rail system for covering joints between at least one of floor and wall coverings, comprising:

a base rail having an upstanding web with a holding head formed at an end of the upstanding web, said holding head being circular in cross-section and extending over a full length of the base rail;

a holding part retained rotationally movably on the holding head, said holding part being designed as a downwardly open U-rail having holding elements for securing the holding part to the holding head; and a covering rail having webs extending downwardly therefrom;

wherein the covering rail is retained on the U-rail in a height-adjustable manner by a structure on the outer walls of the U-rail and a corresponding structure on the webs of the covering rail, to connect the covering rail to the base rail, so that the U-rail and covering rail are retained rotationally movably on the base rail;

wherein the holding part designed as a U-rail receives in the inner space a spring element which consists of strip material and has in cross section a head which is shaped as an arc of a circle of more than 180° and the free ends of which are bent downwardly and outwardly and are supported in the inner sidewalls of the U-rail.

2. The profiled rail system as claimed in claim 1, wherein the spring element is manufactured from sheet steel and as an individual part presses with its head against the upper transverse wall of the U-rail, its downwardly and outwardly directed free ends engage into the structure of the inner sidewalls of the U-rail.

3. The profiled rail system as claimed in claim 1, wherein the holding part has partially, as seen over the length, intermediately formed, spring elements which have in cross section a thin-walled head shaped as an arc of a circle of more than 180° and the free ends of which run outwardly as far as the lower edge of the U-rail, the spring elements and the U-rail portions forming a unit.

4. The profiled rail system as claimed in claim 1, wherein the downwardly open U-rail has on its inner walls at least three webs which are directed toward a center of the inner space, two webs of which are arranged at an interval with respect to one another and the third web is directed toward the center of the interval of the two webs, the webs projecting into the inner space of the U-rail in each case to an extent such that the holding head, pressed between them, of the base rail is retained as a rotary bearing.

5. The profiled rail system as claimed in claim 4, wherein the webs extend over the length of the U-rail.

6. The profiled rail system as claimed in claim 1, wherein the holding part, as seen over the entire length of the covering rail, consists of only short portions distributed at intervals.

7. The profiled rail system as claimed in claim 1, wherein the holding part has at least one spring element and a U-rail segment which are assembled as individual pieces.

8. The profiled rail system as claimed in claim 1, wherein the holding part has at least one spring element and one U-rail segment which are produced as a uniform composite structure from the same material.

9. The profiled rail system as claimed in claim 1, wherein the base rail and the holding part are made of plastic, the plastic of the holding part having high elasticity.

10. The profiled rail system as claimed in claim 1, wherein the outer walls of the U-rail are provided with a structure, into which the downwardly directed webs integrally formed on the covering rail engage with a corresponding structure with a clamping effect.

* * * * *